US006599229B1

(12) United States Patent
South et al.

(10) Patent No.: US 6,599,229 B1
(45) Date of Patent: Jul. 29, 2003

(54) AIR-ASSISTED DRAIN WITH PRESSURE CUTOFF VALVE

(75) Inventors: Kevin C. South, Cookeville, TN (US); Peter K. Herman, Cookeville, TN (US); Hendrik N. Amirkhanian, Cookeville, TN (US)

(73) Assignee: Fleetguard, Inc., Nashville, TN (US)

( * ) Notice: Subject to any disclaimer, the term of this patent is extended or adjusted under 35 U.S.C. 154(b) by 0 days.

(21) Appl. No.: 10/083,972

(22) Filed: Feb. 27, 2002

(51) Int. Cl.[7] ..... B04B 9/06
(52) U.S. Cl. ..... 494/26; 494/49; 494/60
(58) Field of Search ..... 494/5, 6, 24, 26, 494/36, 43, 49, 64, 65, 67, 84, 901, 60; 210/168, 171, 232, 360.1, 380.1, 416.5; 184/6.24

(56) References Cited

U.S. PATENT DOCUMENTS

| | | | | |
|---|---|---|---|---|
| 3,432,091 | A | * | 3/1969 | Beazley |
| 3,762,633 | A | * | 10/1973 | Ishii |
| 4,046,315 | A | * | 9/1977 | Klingenberg et al. |
| 4,221,323 | A | * | 9/1980 | Courtot |
| 4,492,631 | A | | 1/1985 | Martin |
| 4,534,860 | A | | 8/1985 | Budzich |
| 4,591,433 | A | | 5/1986 | Budzich |
| 5,232,588 | A | | 8/1993 | Gryder |
| 5,328,440 | A | | 7/1994 | Chen et al. |
| 5,904,841 | A | | 5/1999 | Penny |
| 5,906,733 | A | * | 5/1999 | Purvey |
| 6,074,336 | A | * | 6/2000 | Purvey |

FOREIGN PATENT DOCUMENTS

| | | | | |
|---|---|---|---|---|
| GB | 735658 | * | 8/1955 | ..... 494/49 |

* cited by examiner

*Primary Examiner*—Charles E. Cooley
(74) *Attorney, Agent, or Firm*—Woodard, Emhardt, Moriarty, McNett & Henry LLP

(57) ABSTRACT

A centrifuge assembly for processing a flow of oil so as to separate out particulate matter includes a centrifuge, a housing base, and a flow-control piston which is assembled into the housing base. The centrifuge includes a housing which defines a hollow interior with a centrifugal separator positioned within the hollow interior for separation of particulate matter from the flow of oil. The housing base defines an incoming oil conduit, a drain conduit, an air-in passageway, and air-out passageway. The flow-control piston is movable between a normally-closed position and an open position in response to incoming oil pressure. When in the closed position, neither oil nor air are able to flow into the centrifuge assembly. In the open position, both oil and air are able to flow into the centrifuge assembly. The air which is introduced is under pressure and provides air-assisted drainage of the oil from the centrifuge housing back to sump.

7 Claims, 7 Drawing Sheets

AIR-ASSISTED DRAIN WITH PRESSURE CUTOFF VALVE

BACKGROUND OF THE INVENTION

The present invention generally relates to the continuous separation of solid particles, such as soot, from a fluid, such as oil, by use of a centrifuge. More specifically, but not exclusively, the present invention relates to a centrifuge housing and base design to permit the controlled introduction of air in order to assist with drainage of the fluid from the centrifuge.

Diesel engines are designed with relatively sophisticated air and fuel filters (cleaners) in an effort to keep dirt and debris out of the engine. Even with these air and fuel cleaners, dirt and debris, including engine-generated wear debris, will find a way into the lubricating oil of the.engine. The result is wear on critical engine components and if this condition is left unsolved or not remedied, engine failure. For this reason, many engines are designed with full flow oil filters that continually clean the oil as it circulates between the lubricant sump and engine parts.

There are a number of design constraints and considerations for such full flow filters and typically these constraints mean that such filters can only remove those dirt particles that are -in the range of 10 microns or larger. While removal of particles of this size may prevent a catastrophic failure, harmful wear will still be caused by smaller particles of dirt that get into and remain in the oil. In order to try to address the concern over small particles, designers have gone to bypass filtering systems which filter a predefined percentage of the total oil flow. Since bypass filters may be able to trap particles less than approximately 10 microns, the combination of a full flow filter and bypass filter offers substantial improvement over the use of only a full flow filter.

One of the realities of centrifuge designs of the type generally described (above) is that the oil drains by the action (force) of gravity. This in turn has an effect on where the centrifuge should be positioned within the engine relative to the location of the oil sump. It is important to position the centrifuge, specifically the centrifuge housing, above the sump so that sufficient head pressure is created to adequately drain the oil from the centrifuge housing. Not only should the volume and completeness of the oil drainage be a factor, but the rate of oil drainage is also important. The concept of "adequate" draining in the context of this invention is that amount or degree or rate of drainage which keeps the oil from backing up to the point that it floods the centrifuge. Flooding the centrifuge effectively negates any beneficial utilization of the centrifuge for separating particulate matter from the oil flowing through the centrifuge.

The requirement to position the centrifuge housing above the sump limits the number of available mounting locations. The need to position the centrifuge housing high enough above the sump to create a sufficient head pressure further limits the number of available mounting locations. As the number of available mounting locations decreases, the number of potential customers that can use this type of centrifuge also decreases. The present invention contemplates and discloses, the use of air pressure to assist with the oil draining from the centrifuge housing, thereby allowing the centrifuge housing to have a greater choice of mounting locations. This in turn increases the number of potential customers for use of this type of centrifuge.

A related design disadvantage of gravity-drain centrifuge housings is the need to use larger diameter hoses coming from the centrifuge drain and going into the sump. The maximum drain flow volume is a function of the minimum cross sectional area of the drain opening and the connecting hose or conduit. It is normal to select a connecting hose size to match the drain outlet in the housing. The need for a large diameter hose is due to the fact that the oil going into the sump needs to vent in order for the oil to reach the sump. Without a large diameter hose, the oil backs up and floods the centrifuge casting.

The present invention provides a novel and unobvious design for an air-assisted drain for a centrifuge housing which uses a pressure cutoff valve. In this way, air is only introduced into the centrifuge housing when the centrifuge is operating and oil is flowing. The same piston arrangement which governs oil inlet flow into the centrifuge rotor also governs and controls the flow of air (under pressure) into the centrifuge housing in order to help push out the oil after processing to separate out particulate matter.

SUMMARY OF THE INVENTION

A centrifuge assembly for processing a fluid according to one embodiment of the present invention is constructed and arranged with air-assisted drainage of the fluid. The centrifuge assembly includes a centrifuge having a centrifuge housing which defines a hollow interior and a fluid processing device, such as a centrifuge rotor, which is positioned in the centrifuge housing interior for centrifugal separation of particulate matter from the fluid. The centrifuge assembly further includes a housing base which defines a fluid-in conduit in flow communication with the centrifuge, a fluid-out drain conduit in flow communication with the centrifuge, an air-in passageway, and an air-out passageway in flow communication with the centrifuge for introducing air into the hollow interior. The centrifuge assembly further includes a flow control piston which is assembled into the housing base and includes a movable piston having a normally-closed position in which the piston blocks the flow of fluid into the centrifuge rotor and blocks the flow of air into the centrifuge housing. The piston is movable to an open position in response to fluid pressure in the fluid-in conduit. With the piston in its open position, fluid is able to flow into the centrifuge rotor and air is able to flow into the centrifuge housing for applying air pressure on the fluid in the centrifuge rotor in order to assist in the drainage of this fluid by way of the fluid-out drain conduit.

One object of the present invention is to provide an improved centrifuge assembly with air-assisted drainage.

Related objects and advantages of the present invention will be apparent from the following description.

DESCRIPTION OF THE PREFERRED EMBODIMENTS

Figure 1:
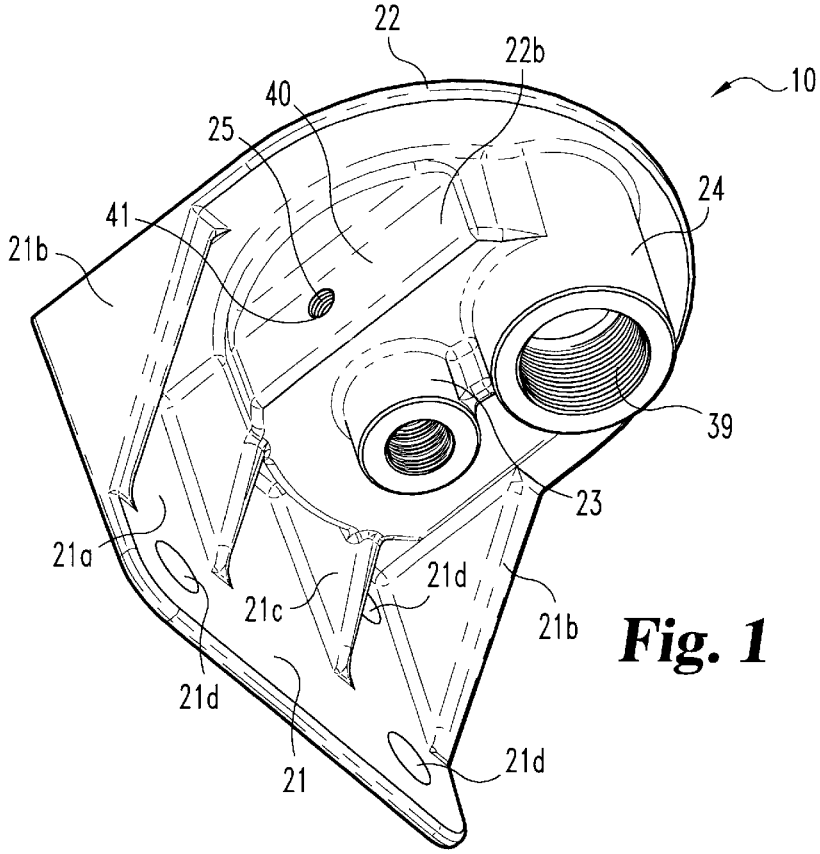
FIG. 1 is a bottom perspective view of a centrifuge housing base according to a typical embodiment of the present invention.
Figure 2:
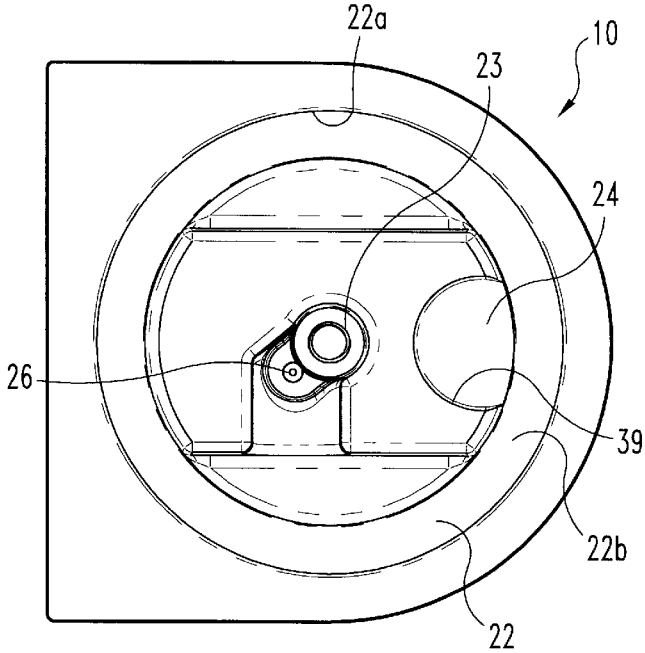
FIG. 2 is a top plan view of the FIG. 1 centrifuge housing base.
Figure 3:
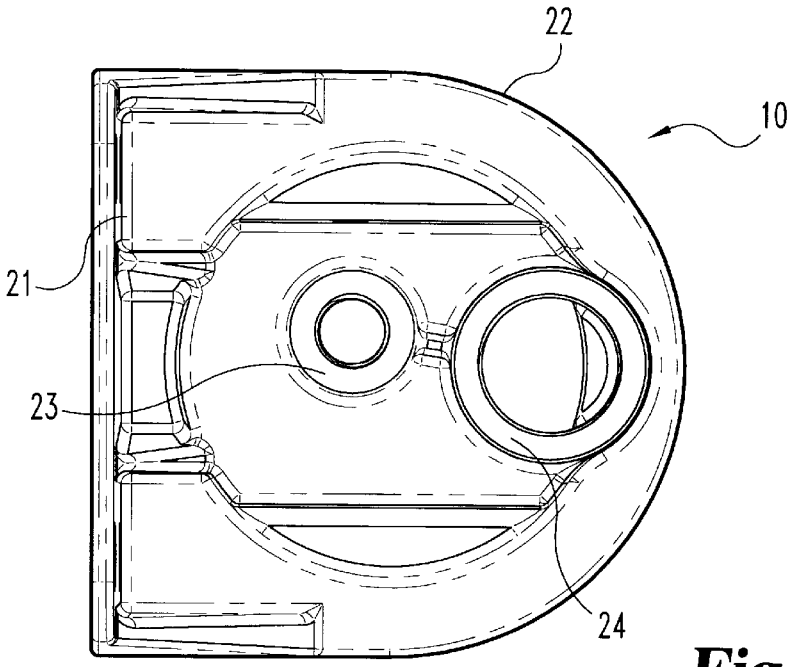
FIG. 3 is a bottom plan view of the FIG. 1 centrifuge housing base.
Figure 4:
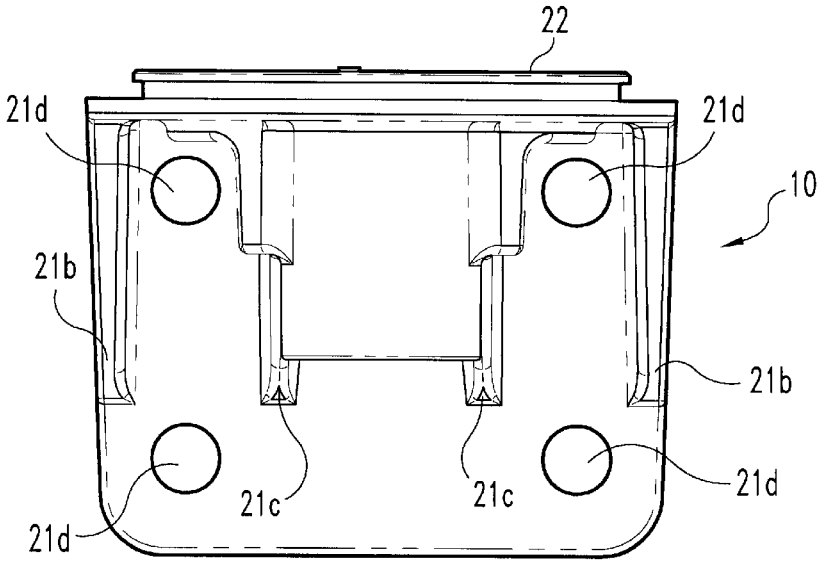
FIG. 4 is a front elevational view of the FIG. 1 centrifuge housing base.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 7:
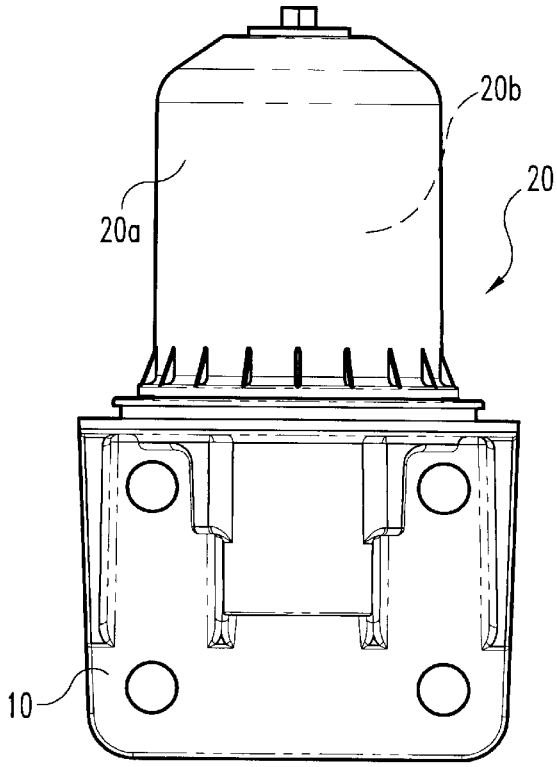
FIG. 7 is a front elevational view of a centrifuge assembly as mounted on the FIG. 1 centrifuge housing base.
Figure 8:
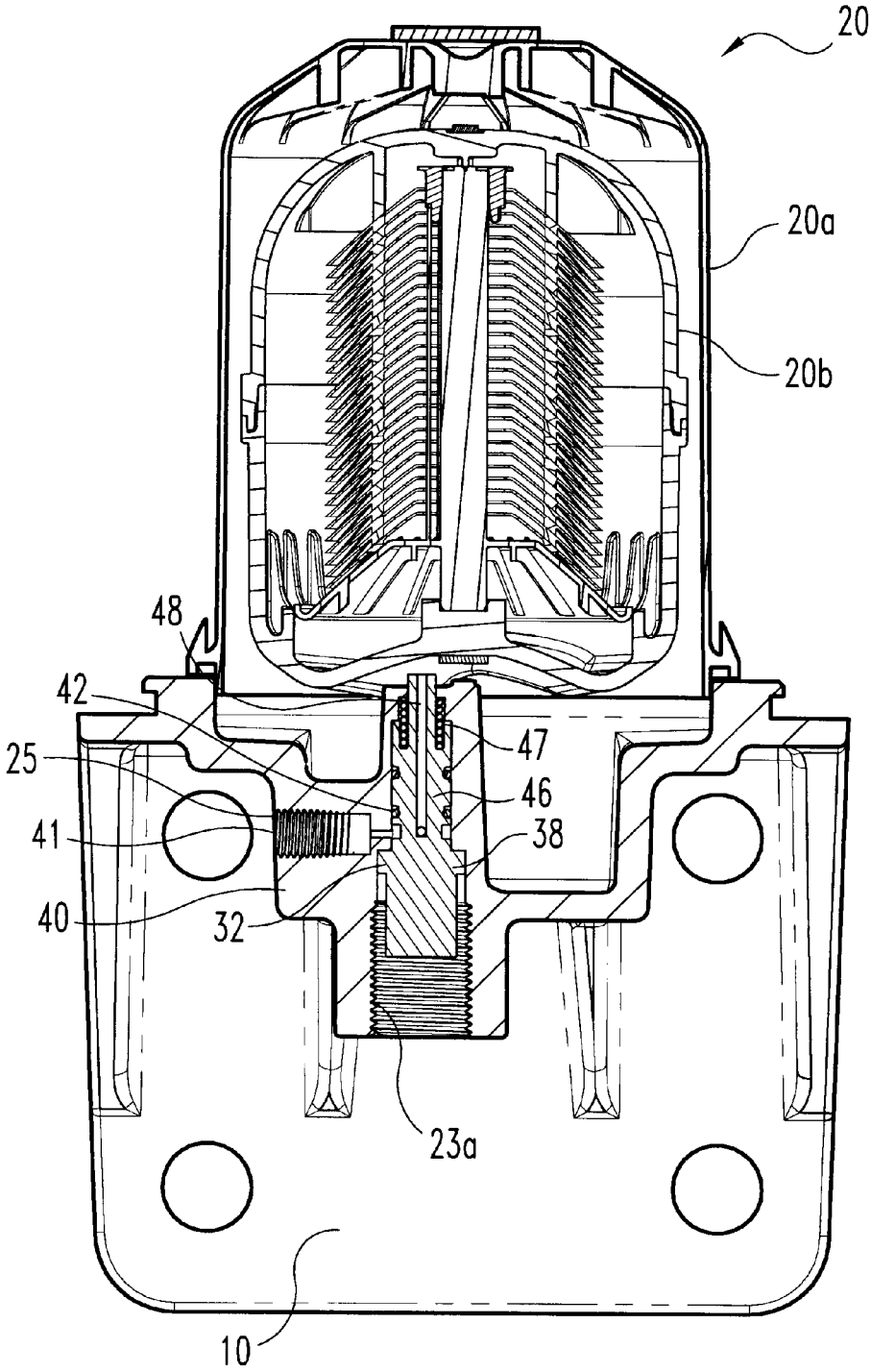
FIG. 8 is a front elevational view, in full section, of the FIG. 7 assembly.

Referring to FIGS. 1 through 6A, there is illustrated a centrifuge housing base 10 for use with a by-pass centrifuge 20 (see FIGS. 7, 8 and 8A) for the separation of particulate matter from a flow of oil that is introduced into the by-pass centrifuge. The by-pass centrifuge 20 includes an outer centrifuge housing 20*a* which defines a hollow interior and a fluid processing device, preferably a centrifuge rotor 20*b*, which is positioned in the centrifuge housing. Housing base 10, which supports centrifuge 20, is a unitary casting and includes a mounting bracket portion 21, a centrifuge support portion 22, and oil conduits 23 and 24. Oil conduit 23 is an oil inlet and oil conduit 24 is an oil drain. Housing base 10 further defines an air-in passageway 25 and an air-out passageway 26. The relative sizes and locations of these conduits and passageways are as illustrated in FIGS. 1 through 6A.

The mounting bracket portion 21 includes a substantially planar wall 21*a*, two reinforcing corner braces 21*b*, two interior braces 21*c*, and four mounting holes 21*d*. The centrifuge support portion 22 includes a generally cylindrical rim 22*a* and a main body 22*b* which defines and receives the various oil conduits 23 and 24 and the air passageways 25 and 26.

The oil inlet conduit 23 is arranged in two generally cylindrical, though axially offset, sections 23*a* and 23*b*. Oil inlet section 23*a* is generally cylindrical with an inside diameter surface 30 that is threaded closest to its open end 31. Internally, above the entrance internal threads, conduit 23 houses a flow-control piston 32 (see FIGS. 5, 6, 6A, 8, and 8A). Piston 32 operates on oil pressure and controls both the flow of oil into the centrifuge rotor 20*b* and the flow of air into the centrifuge housing 20*a*. The design specifics of flow-control piston 32 and its flow-control functions are described in greater detail hereinafter.

Figure 5:
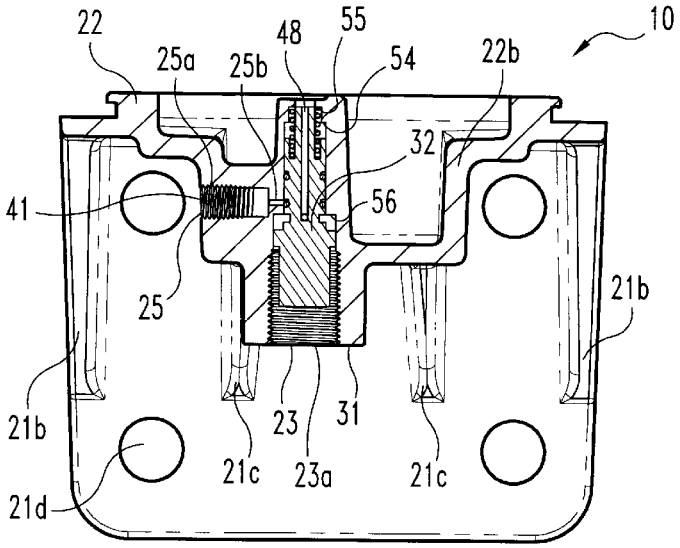
FIG. 5 is a front elevational view, in full section, of a flow control piston as assembled into the centrifuge housing base and in a closed condition.
Figure 5A:
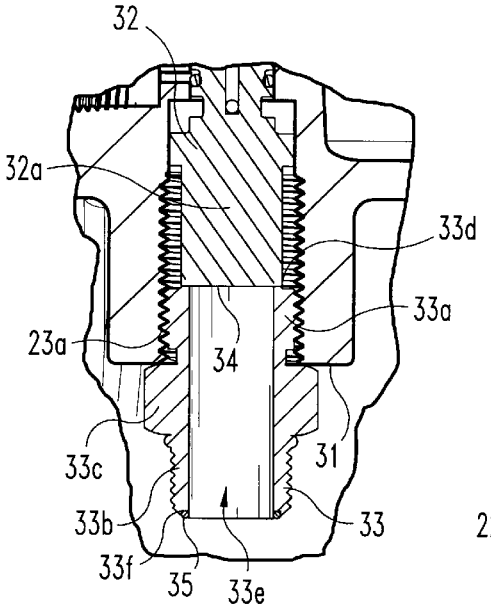
FIG. 5A is an enlarged detail view, in full section, of a (sealing) fitting as installed in the FIG. 1 centrifuge housing base.

In order to understand the entirety of the construction and operation of flow-control piston 32, reference is now made to FIG. 5A. As illustrated, the flow-control piston 32 includes a generally cylindrical extension 32*a* which is axially extending downwardly into section 23*a* of the oil inlet conduit 23. Inserted (threaded) into the opposite end of conduit section 23*a* is a (sealing) fitting 33. Fitting 33 is externally-threaded at upper end 33*a* and is externally-threaded at lower end 33*b* with a hex-shaped body 33*c* positioned therebetween. The externally-threaded end 33*b* is used for the connection of an oil-delivery (inlet) hose or similar fluid-delivery conduit.

The proper assembly of fitting 33 into section 23*a* of oil inlet conduit 23 places the hex body 33*c* up against the (exposed) open end 31 of conduit section 23*a*. The flat face 33*d* of the upper end 33*a* of fitting 33 is positioned up into conduit section 23*a*. The fitting 33 provides a lower abutment stop for the piston extension 32*a* as well as a surface for the piston extension 32*a* to seal up against.

Fitting 33 defines a flow-through aperture 33*e* extending the full axial length of fitting 33. Flow-through aperture 33*e* is used for the incoming flow of oil or other fluid. An O-ring groove 33*f* and O-ring 35 at lower end 33*b* facilitate the sealing of the oil inlet hose. In the closed position of the flow-control piston 32, the lower flat face 34 of the extension 32*a* is spring biased against flat face 33*d* in order to seal closed the flow-through aperture 33*e* . The (sealing) fitting 33 is only illustrated in FIG. 5A for the simplification of the remaining drawings. While the extension 32*a* has been included in all of the other applicable drawings, it should be understood that fitting 33 would be assembled in the manner illustrated in FIG. 5A as part of the present invention.

Figure 6:
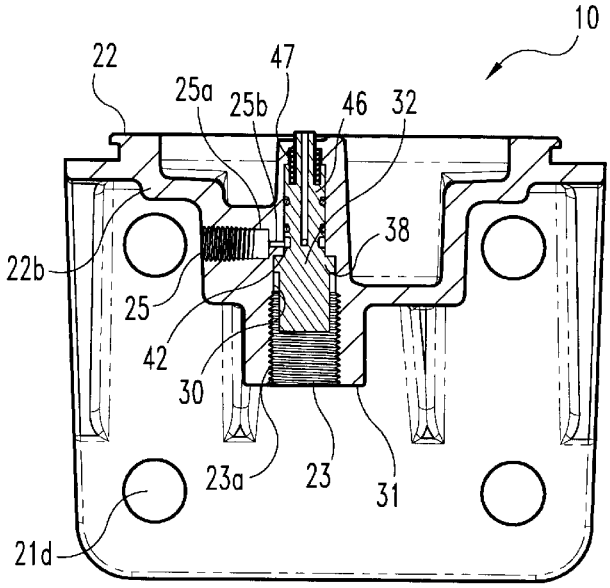
FIG. 6 is a front elevational view, in full section, of the FIG. 5 flow control piston, as assembled, in an open condition.
Figure 6A:
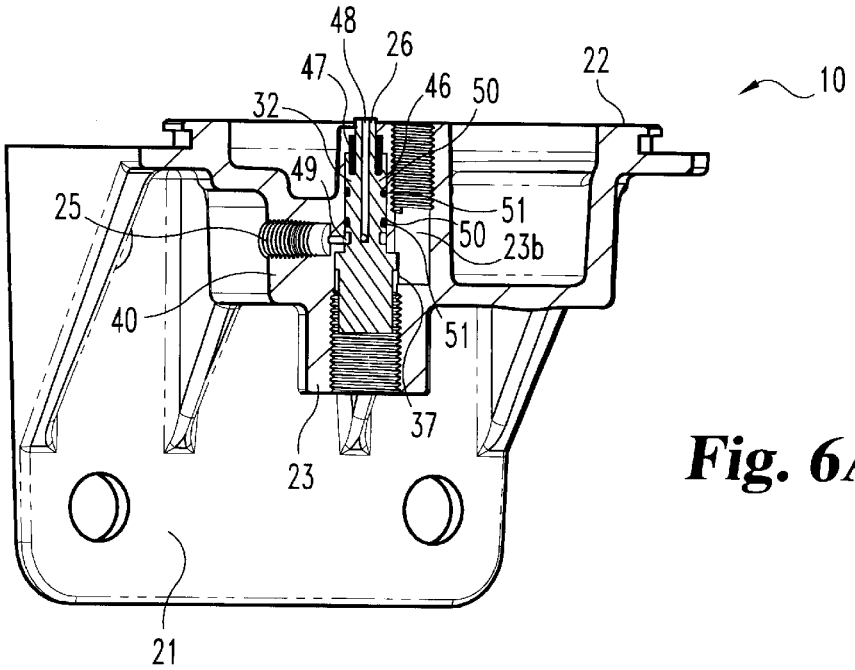
FIG. 6A is a perspective view of the FIG. 5 flow control piston, as assembled into the centrifuge housing base, sectioned to show the oil flow passageway into the centrifuge.
Figure 8A:
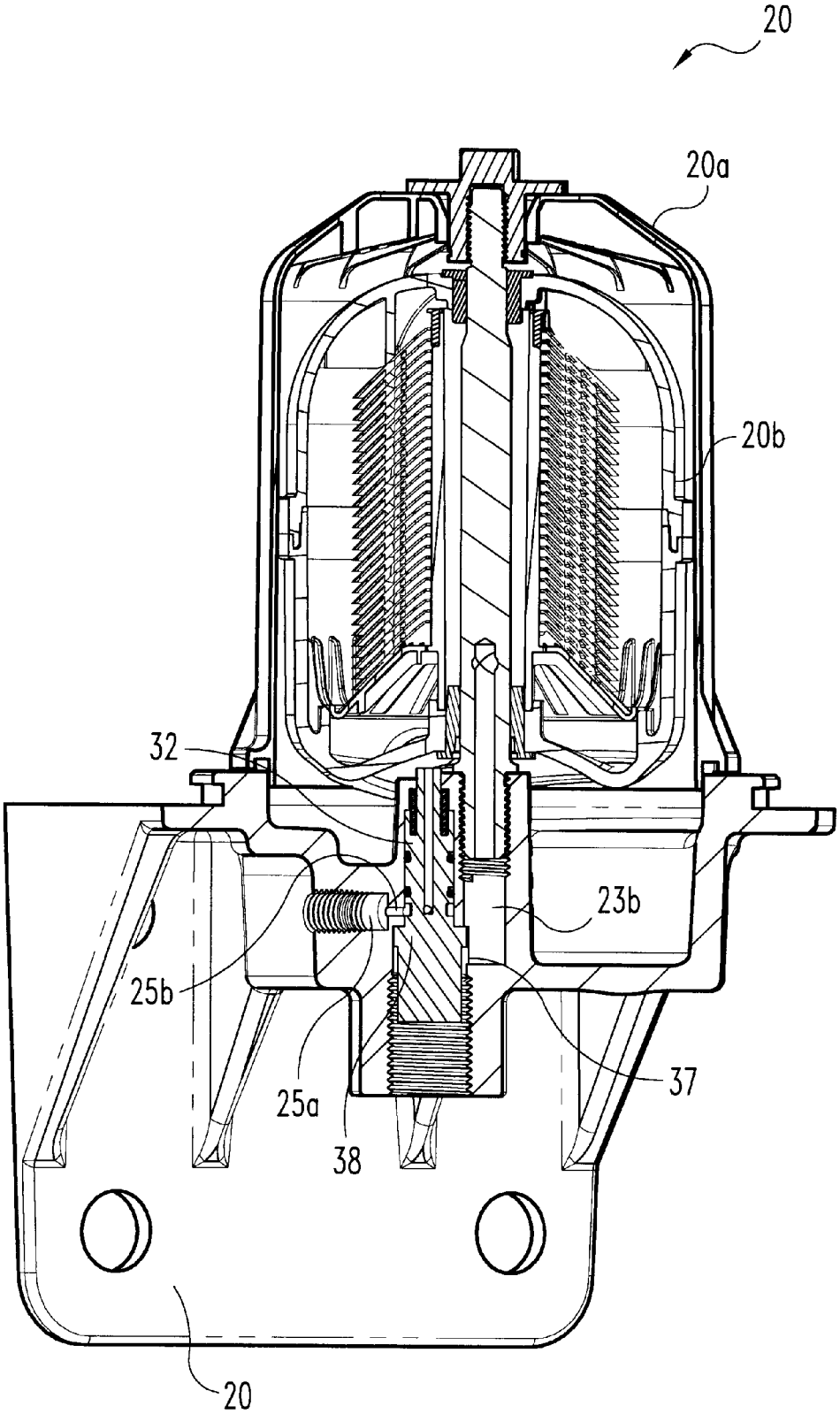
FIG. 8A is a front perspective view, in full section, of the FIG. 7 assembly.

Oil transfer section 23*b* begins in the lower extension of main body 22*b* at flow entrance 37 and is in flow communication with section 23*a* by way of entrance 37 (see FIGS. 6 and 8A). As will be described in greater detail hereinafter, when the flow-control piston 32 is in its lower, closed position, oil is unable to flow into section 23*a* and from section 23*a* to section 23*b* because there is no flow path through entrance 37. In effect, the body 38 of the flow-control piston 32 is positioned where entrance 37 is effectively closed. This closed condition exists when there is no oil pressure or where the oil pressure is low and below the required threshold in order to move the flow-control piston in an upward direction to lift it off of fitting 33. The quantitative measure of "low" is an oil pressure which is not sufficient to push the piston body 38 upwardly off of fitting 33 and to a point that a flow path is created between section 23*a* and section 23*b* by way of entrance 37. Any oil flowing into section 23*b* is able to be delivered to the centrifuge rotor 20*b* for processing.

Oil drain conduit 24 is generally cylindrical with an inside diameter surface 39 that is threaded for facilitating the secure connection of a drain hose that routes exiting oil back to sump. The inside diameter size of the oil drain conduit 24 limits the size of drain hose which can be connected. Ultimately the size of drain hose limits the volumetric flow of the exiting (i.e., draining) oil. The oil drain conduit 24 is in direct flow communication with the drain reservoir volume of the centrifuge. Oil that is finished with centrifugal separation is directed to the drain reservoir volume at which location it is able to exit by way of the oil drain conduit 24.

The air-in passageway 25 is positioned in sidewall 40 of the main body 22*b* and extends inwardly to a point of intersection with air-out conduit 26. Passageway 25 is arranged into two generally concentric sections 25*a* and 25*b*. Section 25*a*, which is internally threaded, begins at opening 41 and extends inwardly into sidewall 40 to its end point, interior to sidewall 40, at which end point section 25*b* begins. Section 25*b*, which is generally cylindrical, has a smaller inside diameter than section 25*a* and completes, in cooperation with section 25*a*, the passageway through sidewall 40 from opening 41 to machine bore 42 which houses part of the flow-control piston 32.

Figure 9:
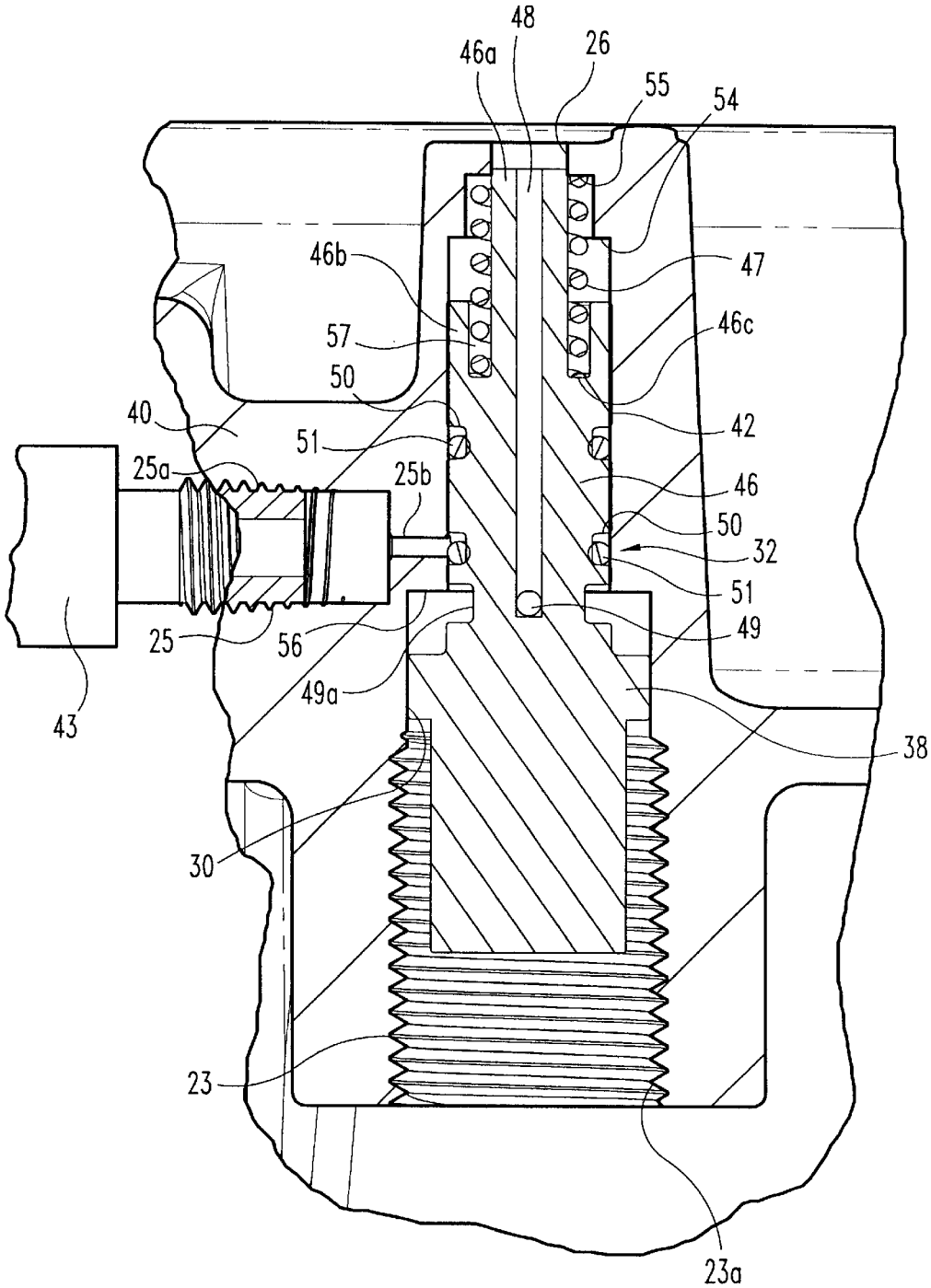
FIG. 9 is an enlarged, front elevational view, in full section, of a flow-control valve comprising one part of the present invention.

Section 25*a* of air-in passageway 25 is constructed and arranged to receive an air pressure regulator valve 43 in order to control the pressure and volume of air to be delivered to the interior of the centrifuge (i.e., into the centrifuge housing 20*a*), by way of the air-in passageway 25, machine bore 42, and air-out passageway 26. Air pressure regulator valve 43 is diagrammatically illustrated in FIG. 9 only and is omitted from the other drawings, simply to provide less drawing complexity. A suitable air pressure regulator valve for this application is a model number MAR-1-2 regulator valve, offered by Clippard Minimatic of Cincinnati, Ohio. The air-out passageway 26 is concentric with the machined bore 42 which is concentric with the oil inlet section 23*a* of oil-in conduit 23. This design allows the cylindrical sections to be cast and machined in-line, after which the flow-control piston 32 is installed. The flow-control piston 32 can be thought of as an oil pressure cutoff valve since its operable state is controlled by the incoming flow of oil by way of the oil-in conduit 23 and specifically by way of oil inlet section 23*a*.

The flow-control piston 32 or oil pressure cutoff valve (see FIG. 9) includes, in addition to body 38, stem 46, compression spring 47, centered air passageway 48, air inlet 49, air relief groove 49*a*, a pair of seal grooves 50, and elastomeric O-ring seals 51, one each being installed in each groove 50. The machined bore 42 which is in axial and concentric combination with the air-out passageway 26, defines two radial shoulders 54 and 55. The oil-in conduit defines radial shoulder 56 in combination with machined bore 42.

The stem 46 of the flow-control piston 32 includes a center post 46*a* and an outer sleeve 46*b* with a radial base 46*c*. One end of compression spring 47 is captured in annular clearance space 57 located at one end of outer sleeve 46*b* between the center post 46*a* and the outer sleeve 46*b*. Compression spring 47 seats against radial base 46*c*. The uppermost end of center post 46*a* is captured in air-out passageway 26 and is securely held in that location. The piston body 38 is integral with the outer sleeve 46*b*, such that axial movement of the piston body 38 results in axial movement of the outer sleeve 46*b*, and vice versa. Since the center post 46*a* is stationary relative to the main body 22*b*, upward movement of the piston body 38 compresses spring 47.

In operation, the cutoff valve 32 begins at the rest position or closed condition in terms of any oil flow. In this orientation, the compression spring is extended and the piston body is at its lowest point. In this position, the extension 32*a* is biased against the upper face 33*d* of fitting 33. Entrance 37 is blocked due to the location of entrance 37 relative to the position of the piston within oil-in conduit 23, specifically, oil inlet-section 23*a*. The air relief groove 49*a*, which is in flow communication with air inlet 49 which flows into air passageway 48, is axially below the location of air-in section 25*b*. As such, the outer surface of outer sleeve 46*b* blocks the interior opening of section 25*b*, thereby preventing the flow of air into the centrifuge. In this closed or at rest condition, neither oil nor air is flowing into the centrifuge.

When there is an incoming flow of oil, from a source of oil connected to oil-in conduit 23, at or above a threshold pressure level which is sufficient to override the force exerted by the compression spring 47, the piston body 38 is able to move in an axially upward direction based on the centrifuge orientation as illustrated in the drawing figures. As the compression spring 47 compresses, a greater oil pressure level is required to continue moving the piston body. However, assuming that the incoming oil pressure is sufficient and remains at a sufficient level to lift the piston body 38 to the approximate location of radial shoulder 56, it should be clear from the drawing illustrations that, in this open orientation, entrance 37 is "open" a sufficient degree to permit the flow of oil from oil inlet section 23*a* to oil transfer section 23*b* , and from there, the oil is able to flow into the centrifuge rotor 20*b* for processing.

The upward axial movement of the piston body 38 also means the upward axial movement of the outer sleeve 46*b* which includes air relief groove 49*a* and air inlet 49. The axial positioning of the upper surface of piston body 38 into abutment against radial shoulder 56 also positions the air relief groove 49*a* directly in line with air-in passageway section 25*b*. With the end of section 25*b* no longer blocked by the outer surface of outer sleeve 46*b*, air is able to flow. Accordingly, with a source of air connected to air-in section 25*a*, and with this air at a pressure above atmospheric, the air is able to flow from passageway 25 into air passageway 48 by way of air inlet 49 and air relief groove 49*a*. From air passageway 48, the air flows into the centrifuge housing 20*a*. The introduction of air into the centrifuge housing 20*a* helps to push the oil to be drained out of the drain reservoir of the centrifuge at a faster drainage rate than what is possible by merely an unassisted drainage of oil from the centrifuge, due solely to the effects of gravity and accordingly head pressure.

A further point to note with regard to the installation and orientation of the flow piston 32 is that its use in this application is not limited to a vertical orientation, as illustrated. The flow control piston 32 can be oriented over a full ninety degree range from vertical to horizontal, without any effect on its performance or its suitability for the described application. This added degree of freedom in orienting the flow control piston 32 provides added versatility to the present invention and, in particular, greater versatility in the configuration of the housing base 10.

By providing this air-assisted drainage, greater variety of mounting locations can be provided for the centrifuge assembly, since the oil to be drained will actually be pushed from the centrifuge due to air pressure, lessening, if not virtually eliminating, any concerns of relative height of the centrifuge assembly above the sump. Additionally, the air-assisted drainage according to the present invention permits the use of a smaller diameter drainage hose.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A centrifuges assembly for processing a liquid and being constructed and arranged with air-assisted drainage of the liquid, said centrifuge assembly comprising:

a centrifuge including a housing, a housing base connected to said housing and a rotor, said housing and said housing base cooperating to define a hollow interior, said rotor being positioned in said hollow interior, said housing base further defining a liquid-flow passageway therein that is in communication with said rotor and defining an air-in passageway therein that is in communication with said hollow interior, wherein said liquid-flow passageway is constructed and arranged with a first section and a second section and an entrance aperture disposed between said first section and said second section for fluid flow communication from said first section into said second section;

a flow-control piston assembled into said liquid-flow passageway, said flow-control piston being constructed and arranged to be movable between a first position and a second position, when in said first position said flow-control piston blocks the flow of air into said hollow interior and when in said second position said flow-control piston permitting the flow of air into said hollow interior, wherein a first portion of said flow-control piston is positioned in said first section adjacent said entrance aperture; and wherein said housing base defines an air-out passageway and a second portion of said flow-control piston is positioned in said air-out passageway.

2. The centrifuge assembly of claim 1 wherein said flow control piston is spring-biased.

3. The centrifuge assembly of claim 2 wherein said housing base further defines a first air section that is constructed and arranged to receive an air pressure regulator valve.

4. A method of :performing the task of air-assisted drainage of liquid from a centrifuge assembly which is constructed and arranged for processing said liquid, said method comprising the following steps:

providing a centrifuge for centrifugal separation of particulate matter from said liquid, said centrifuge including a housing, a housing base connected to said housing and a rotor, said housing and said housing base cooperating to define a hollow interior, said rotor being positioned in said hollow interior, said housing base further defining a liquid-flow passageway therein that is in communication with said rotor and defining an air-in passageway therein that is in communication with said hollow interior;

providing a flow-control piston;

installing said flow-control piston in said liquid-flow passageway;

connecting a source of liquid to said liquid-flow passageway; and connecting a source of air to said air-in passageway, wherein the pressure of said liquid upstream of said flow-control piston governs the state of said flow-control piston, said flow-control piston being constructed and arranged to be movable between a first position and a second position, when in said first position said flow-control piston blocks the flow of air into said hollow interior and when in said second position said flow control piston permitting the flow of air into said hollow interior.

5. The method of claim 4 which further includes the step of configuring said air-in passageway for receipt of an air pressure regulator valve.

6. A centrifuge assembly for processing a liquid and being constructed and arranged with air-assisted drainage of the liquid, said centrifuge assembly comprising:

a centrifuge including a housing, a housing base connected to said housing and a rotor, said housing and said housing base cooperating to define a hollow interior, said rotor being positioned in said hollow interior, said housing base further defining a liquid-flow passageway therein that is in communication with said rotor and defining an air-in passageway therein that is in communication with said hollow interior; and a flow-control piston assembled into said liquid-flow passageway, said flow-control piston defining an air passageway that is constructed and arranged for flow communication with said air-in passageway.

7. The centrifuge assembly of claim 6 wherein said flow-control piston is constructed and arranged to be movable between a first position and a second position, when in said first position said flow-control piston blocks the flow of air into said hollow interior and when in said second position said flow control-piston permitting the flow of air into said hollow interior.

* * * * *